US011011340B2

(12) United States Patent
Woon et al.

(10) Patent No.: US 11,011,340 B2
(45) Date of Patent: May 18, 2021

(54) ION GENERATION COMPOSITE TARGET AND LASER-DRIVEN ION ACCELERATION APPARATUS USING THE SAME

(71) Applicant: National Central University, Taoyuan (TW)

(72) Inventors: Wei-Yen Woon, Taoyuan (TW); Kuramitsu Yasuhiro, Osaka (JP)

(73) Assignee: National Central University, Taoyuan (TW)

( * ) Notice: Subject to any disclaimer, the term of this patent is extended or adjusted under 35 U.S.C. 154(b) by 0 days.

(21) Appl. No.: 16/687,822

(22) Filed: Nov. 19, 2019

(65) Prior Publication Data

US 2021/0035768 A1 Feb. 4, 2021

(30) Foreign Application Priority Data

Jul. 29, 2019 (TW) ..... 108126809

(51) Int. Cl.
*H01J 27/24* (2006.01)
*H01J 27/02* (2006.01)

(52) U.S. Cl.
CPC ..... *H01J 27/24* (2013.01); *H01J 27/022* (2013.01)

(58) Field of Classification Search
CPC ..... H01J 27/00; H01J 27/02; H01J 27/022; H01J 27/24; H01J 37/08; H01J 49/16; H01J 49/161; H01J 49/162; H01J 49/164; A61N 5/1077
See application file for complete search history.

(56) References Cited

U.S. PATENT DOCUMENTS 8,907,299 B2 * 12/2014 Choi ..... C23C 14/0005 250/423 R
2013/0138184 A1 * 5/2013 Jung ..... H01J 37/08 607/100
2013/0178689 A1 * 7/2013 Jung ..... A61N 5/1077 600/1
2013/0261369 A1 * 10/2013 Jung ..... H05H 6/00 600/1
2013/0289331 A1 * 10/2013 Jung ..... H01J 27/02 600/1
2015/0038761 A1 * 2/2015 Kim ..... A61N 5/1077 600/1

OTHER PUBLICATIONS

Khasanah et al, "Large-Area Suspended Graphene as a Laser Target to Produce an Energetic Ion Beam", High Power Laser Science and Engineering, 2017, vol. 5, e18) (Year: 2017).*
Nur Khasanah, Nima Bolouki, Tzu-Yao Huang, Yi-Zhe Hong, Wen-Liang Chung, Wei-Yen Woon, Ching-Yuan Su, and Yasuhiro Kuramitsu, "Large-area suspended graphene as a laser target to produce an energetic ion beam", High Power Laser Science and Engineering, (2017), vol. 5, e18, 5 pages., Published online by Cambridge University Press.

* cited by examiner

*Primary Examiner* — David E Smith
(74) *Attorney, Agent, or Firm* — Demian K. Jackson; Jackson IPG PLLC

(57) ABSTRACT

The present invention relates to an ion generation composite target for an ion irradiation technology including: a substrate having a through hole formed thereon; and a graphene thin film configured on the substrate, across the through hole, having a thickness in a range between 1 nm to 3 nm, and ionized to release a proton or a carbon ion.

6 Claims, 16 Drawing Sheets

ION GENERATION COMPOSITE TARGET AND LASER-DRIVEN ION ACCELERATION APPARATUS USING THE SAME

CROSS-REFERENCE TO RELATED APPLICATION

The present application claims the priority benefit of Taiwan invention patent application serial No. 108126809, dated Jul. 29, 2019, filed in Taiwan intellectual property office. All contents disclosed in the above Taiwan invention patent application is incorporated herein by reference.

FIELD

The present invention relates to an ion generation composite target and a laser-driven ion acceleration apparatus using the same composite target, in particular to an ion generation composite target including a graphene thin film and a laser-driven ion acceleration apparatus using the same composite target.

BACKGROUND

In recent years, an application utilizing a laser-driven ion acceleration (LIA) mechanism to generate energetic particles, especially to irradiate an acceleration for protons, has become very popular and drawn lots of attentions, due to its own critical prospects in engineering and medical field, as well as important scientific connotations, such as: the proton cancer therapy, the fusion ignition, the elementary particle research, the high-energy physics research, and the astrophysics research. In particular, a laser plasma accelerator apparatus has a volume size as much more compact as compared to the conventional accelerator, and even is able to be built as a table-top device.

The LIA mechanism is also well known as a laser plasma acceleration, or a laser wake field acceleration, etc., and usually defined and described through a fundamental theoretical model known as a target normal sheath acceleration (TNSA) model. In the TNSA model, it uses a high-energy laser beam to bombard a solid target, to cause a powerful Coulomb explosion at a front side thereof, so as to instantly heat up and ionize the composition materials of the solid target into a plasma state. A group of ionized hot electrons in the plasma cloud is thus pushed away and driven by the ponderomotive force from a laser electromagnetic wave, pass through the solid target, exit from the rear end thereof, and then aggregate to form a thin layer of hot electrons (a.k.a. plasma sheath). The aggregation of hot electrons simultaneously induces a strong electrostatic field, which pulls a group of ionized protons moving forward, and is capable of accelerating the ionized protons up to a very high energy level of million electron volts (MeV).

FIG. 1 is a diagram illustrating a fundamental model for a laser wake field proton acceleration in a prior art. In FIG. 1, a high-energy laser beam 10 emitted by a pulsed laser source, goes toward a solid target 12 to bombard and ionize the composition materials of the solid target 12, and a group of ionized hot electrons is consequently excited to move far away from the solid target 12 and form an arc-shaped hot electrons layer 14. An electrostatic field correspondingly induced is able to drag a group of protons 16 to move forward synchronously. However, the induced electrostatic field has an intensity that rapidly attenuates and drops down within a very short distance. Thus when applied to a laser wake field acceleration mechanism, the thickness of the solid target 12 should be formed as thin as possible to enhance the overall acceleration efficiency to the protons. Nevertheless, if the thickness of the solid target is less to a certain threshold, it results in a new issue that a target with an ultra-thin thinness can hardly bear a bombardment caused by a pre-pulse laser from a high-energy laser.

FIG. 2 is a relationship diagram illustrating an intensity of a laser pulse with respect to time in the prior art. When a laser wake field is applied to accelerate elementary particles, since in the state of the art, a high-energy laser is implemented in a pulsed way, a pre-pulse is generated before the main pulse is excited. As shown in FIG. 2, although the intensity of the pre-pulse is slightly lower than that of main pulse, the duration of the pre-pulse is relatively much longer as compared to that of the main pulse. It is estimated that the total power generated by the pre-pulse is even ten times larger than that of the main pulse, in addition to the strong heating effect that the pre-pulse applies to the target. Therefore, a target with an ultra-thin thinness can never bear a bombardment caused by a pre-pulse laser, and is destroyed and fails to function, prior to the arrival of the main pulse. Although a target with thicker thickness can survive over a bombardment caused by a pre-pulse laser, but its thicker thickness will significantly lower the overall acceleration efficiency to the protons.

Hence, there is a need to solve the above deficiencies/issues. It is necessary to develop and produce an ultra-thin solid target that is capable of bearing a bombardment caused by a pre-pulse laser and not being damaged, and at the same time receiving an excitation from the pre-pulse to achieve a maximum level of ionization, to emit more ions or heavy ions. Upon the main pulse arrives, the laser wake field is successfully created by hot electrons or ions to accelerate the target particles.

SUMMARY

In view of a prior art in which a single-layer hydrocarbon (CH-based) target is commonly used for laser-driven ion acceleration, during which because the thickness of a hydrocarbon target is typically ultra-thin, so the structure is too fragile to bear the bombardment of high-energy laser beam pre-pulse. The target has been damaged before the main pulse arrives, resulting in poor acceleration effect of ions. Therefore, the present invention provides a composite target by combining graphene film with substrate, as well as a composite target with a graphene film as a scaffold to carry the film formed by any material.

The present invention resolves an issue of the prior art in which carbon based materials are easy to be made into so thin targets that they are also susceptible to be damaged by pre-pulse during the generation of carbon ions. Therefore, the ion-generating composite target provided by the present invention uses a graphene film as a main material together with a substrate to serve as a composite target, or uses the super strong bonding structure of carbon atom in the graphene material itself as a scaffold to support the fragile film made of any material and serves as a composite target. The composite target of the invention is able to bear the bombardment of pre-pulse and can release a large amount of various ions.

The present invention provides an ion generation composite target for an ion irradiation technology including a substrate having a through hole formed thereon; and a graphene thin film configured on the substrate, across the through hole, having a thickness in a range between 1 nm to 3 nm, and ionized to release a proton or a carbon ion.

Preferably, the ion generation composite target further includes one of the components as follows: a plurality of layers of the graphene thin film configured on the substrate, across the through hole, and each of the plurality of layers of the graphene thin film having a thickness in a range between 1 nm to 3 nm; a carbon-based thin film configured on the graphene thin film, having a thickness less than 20 nm, and ionized to release a proton or a carbon ion; a hydrocarbon-based thin film configured on the graphene thin film, having a thickness less than 20 nm, and ionized to release a proton or a carbon ion; and a metallic material thin film configured on the graphene thin film, having a thickness in a range between 1 nm to 4 nm, and ionized to release a proton or a metallic material ion.

Preferably, the ion generation composite target is manufactured by implementing one selected from a rapid-thermal chemical vapor deposition scheme, a vapor deposition scheme, a rapid thermal anneal scheme, an atomic layer deposition scheme, a spin coating scheme, an electrolysis bubble scheme, a wet transfer scheme, a dry transfer scheme, and a combination thereof.

Preferably, the carbon-based thin film is one selected from an acrylic thin film, a PMMA thin film, a plastic thin film, and an organic polymer thin film, the hydrocarbon-based thin film is one selected from an acrylic thin film, a PMMA thin film, a plastic thin film, and an organic polymer thin film, the metallic material thin film is one selected from a precious metal thin film, a gold thin film, and a copper foil.

The present invention further provides an ion generation composite target for an ion irradiation technology including: a substrate having a through hole formed thereon; and a plurality of layers of a graphene thin film configured on the substrate, across the through hole, each of the plurality of layers of the graphene thin film having a thickness in a range between 1 nm to 3 nm, and ionized to release a proton or a carbon ion.

The present invention further provides a laser-driven ion acceleration apparatus including: a laser emitting a laser beam; and a composite target including: a substrate having a through hole providing for the laser beam to pass through; and a graphene thin film configured on the substrate, across the through hole, having a thickness in a range between 1 nm to 3 nm, and ionized to release a proton or a carbon ion.

Preferably, the composite target further includes one of the components as follows: a plurality of layers of the graphene thin film configured on the substrate, across the through hole, and each of the plurality of layers of the graphene thin film having a thickness in a range between 1 nm to 3 nm; a carbon-based thin film configured on the graphene thin film, having a thickness less than 20 nm, and ionized to release a proton or a carbon ion; a hydrocarbon-based thin film configured on the graphene thin film, having a thickness less than 20 nm, and ionized to release a proton or a carbon ion; and a metallic material thin film configured on the graphene thin film, having a thickness in a range between 1 nm to 4 nm, and ionized to release a proton or a metallic material ion.

Preferably, the composite target is configured to use the graphene thin film as a front side to contact the laser beam first, the composite target is configured to use the plurality of layers of the graphene thin film as a front side to contact the laser beam first, the composite target is configured to use the carbon-based thin film as a front side to contact the laser beam first, the composite target is configured to use the hydrocarbon-based thin film as a front side to contact the laser beam first, and the composite target is configured to use the metallic material thin film as a front side to contact the laser beam first.

Preferably, the front side has a normal line which is angled with the laser beam in range between 0° degree to 60° degree.

DESCRIPTION OF THE DRAWINGS

A more complete appreciation of the invention and many of the attendant advantages thereof are readily obtained as the same become better understood by reference to the following detailed description when considered in connection with the accompanying drawing, wherein.

DETAILED DESCRIPTION

Figure 1:
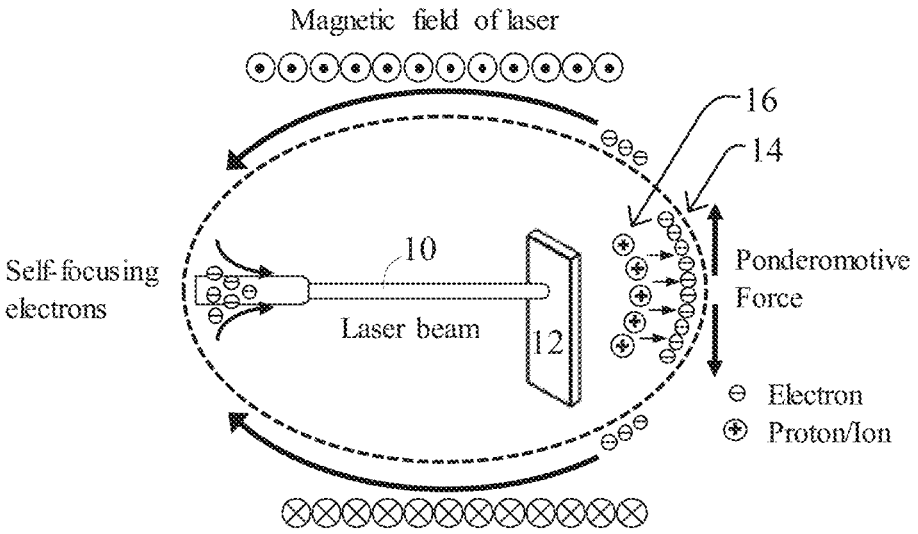
FIG. 1 (PRIOR ART)
FIG. 1 is a diagram illustrating a fundamental model for a laser wake field proton acceleration in a prior art.
Figure 2:
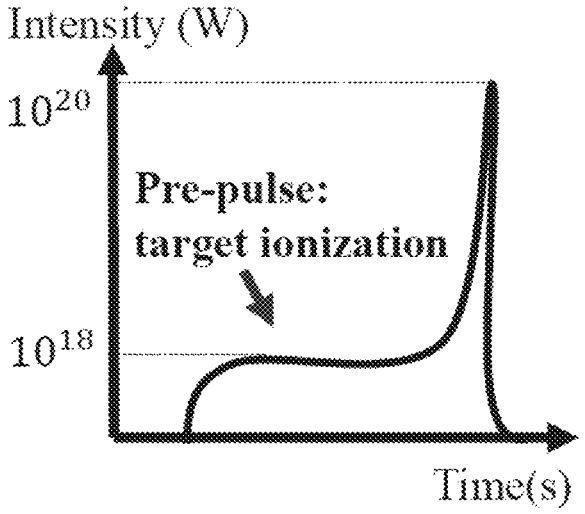
FIG. 2 (PRIOR ART)
FIG. 2 is a relationship diagram illustrating an intensity of a laser pulse with respect to time in the prior art.

The present disclosure will be described with respect to particular embodiments and with reference to certain drawings, but the disclosure is not limited thereto but is only limited by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice.

It is to be noticed that the term "including", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device including means A and B" should not be limited to devices consisting only of components A and B.

The disclosure will now be described by a detailed description of several embodiments. It is clear that other embodiments can be configured according to the knowledge of persons skilled in the art without departing from the true technical teaching of the present disclosure, the claimed disclosure being limited only by the terms of the appended claims.

The present invention uses large area suspended graphene (LSG) as a composite target. Taking a conventional rectangular target as an example, its length or width is generally less than 10 μm. However, the length of a long side of an LSG composite target provided by the present invention, with a rectangular LSG composite target as an example, is better but not limited to exceed 400 μm, and better but not limited to exceed 500 μm. The actual length can vary depending on the laser power, but the thickness can still be maintained at an ultra-thin nanometer of 1 nm. For such a relatively large area, characteristics of high flatness, uniformity and homogeneity are still maintained. Furthermore, the invention can accurately control the growth thickness of LSG by using chemical vapor deposition (CVD), rapid-thermal chemical vapor deposition (RTCVD), or atomic layer deposition (ALD) and other technologies to grow LSG, and the manufacturing cost of the LSG composite target of the present invention is relatively inexpensive.

The LSG composite target provided by the present invention has a relatively thin thickness compared to the radiation pressure acceleration (RPA). Preferably, the thickness of a single layer of graphene film can be as thin as 1 nm. Single layer of graphene film can be as thin as 1 nm. After stacking, the thickness of a multilayer graphene film is preferably between 10 nm and 100 nm. Compared to the thicker target used in a conventional proton acceleration technology, more ions can be radiated to form a higher density of ion group, and ions can be accelerated more efficiently. Moreover, the LSG composite target of the present invention is easy to be mass produced, and has a wide range of applications. For example, it can be used as a target for proton acceleration, a target for nuclear fusion ignition, a target for cancer treatment, and applied in the fields of elementary particle research, high-energy physics research, and astrophysics research, etc.

In the present embodiment, RTCVD is taken as an example to illustrate the fabrication of a graphene film. Firstly, a copper foil is used as a basic growth substrate for graphene. The surface of the copper foil to be used as a growth substrate is subjected to an electro-polishing surface treatment, and then acetone and DI water are used to clean the treated copper foil substrate in order to remove the possible residual organic pollution sources on the surface of the copper foil substrate.

Figure 3:
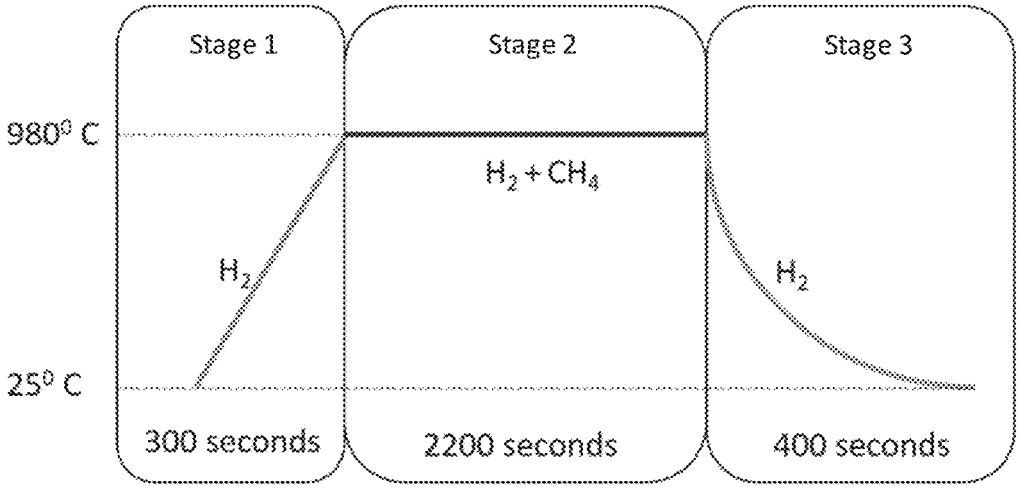
FIG. 3 is a schematic diagram illustrating each reaction stage in a RTCVD process used to from a graphene film in accordance with the present invention.

FIG. 3 is a schematic diagram illustrating each reaction stage in a RTCVD process used to from a graphene film in accordance with the present invention. In the implementation of RTCVD process, a copper foil substrate is placed in an RTCVD reaction chamber, as shown in FIG. 3. The RTCVD process consists of three main stages. The first stage is a rapid temperature rise stage, in which the temperature of the reaction chamber is increased linearly from 25° C. to 980° C. in about 300 seconds, and a hydrogen gas flow is passed through the reaction chamber. The second stage is a heat treatment stage, in which the temperature of the reaction chamber is maintained at 980° C. for about 2,200 seconds, and a mixed gas flow of hydrogen and methane is passed through the reaction chamber at about 50-100 sccm (standard cubic centimeter per minute). A gas pressure of about 1.5 Torr is simultaneously maintained in the reaction chamber. The third stage is a RTA stage, in which the temperature of the reaction chamber is exponentially lowered from 980° C. in about 400 seconds, and at this stage a hydrogen gas flow is passed through the reaction chamber.

An ultra-thin graphene film is mainly grown on a copper foil substrate in the second stage, in which carbon source is supplied via a mixed gas flow of hydrogen and methane. The total thickness of graphene grown on the copper foil substrate can be determined by controlling the operating time of stage 2. After the third stage RTA treatment, the graphene film formed in the second stage can be further transformed into a highly crystalline structure, and the thickness of the single layer of ultra-thin graphene film can be as thin as 1 nm. Then, by performing a spin coating process, a layer of PMMA coating is formed on the graphene film on the copper foil substrate to temporarily protect the graphene film on the copper foil substrate, and also forms a composite target together with the graphene film.

Figure 4:
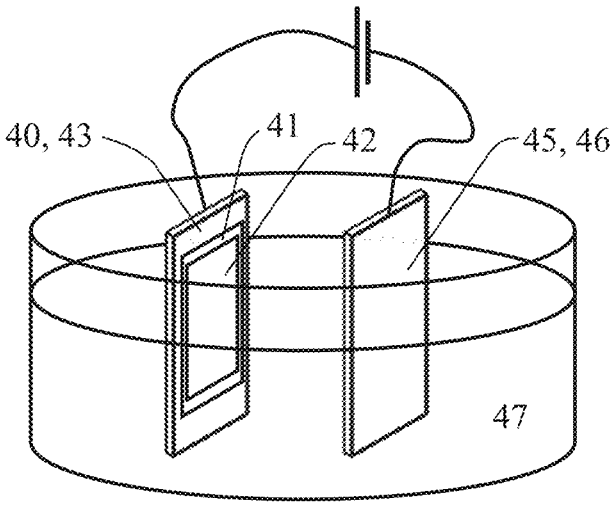
FIG. 4 is a schematic diagram illustrating an electrolytic bubble scheme used for removing a copper foil substrate formed on a graphene film in accordance with the present invention.

FIG. 4 is a schematic diagram illustrating an electrolytic bubble scheme used for removing a copper foil substrate formed on a graphene film in accordance with the present invention. A copper foil substrate 40, a graphene film 41 and a PMMA coating 42 are collectively used as a cathode 43, a suitable conductor 45 is used as an anode 46, and an aqueous solution 47 of sodium hydroxide (NaOH) is used as an electrolyte. The cathode 43 and anode 46 are immersed in the aqueous solution 47, and after a steady current is applied between the cathode 43 and the anode 46, a redox reaction begins between the cathode 43 and the anode 46 and an electrolysis reaction occurs in the aqueous solution 47. During the process, the cathode 43 generates a large amount of hydrogen bubbles, such that the copper foil substrate 40 attached to the graphene film 41 is peeled off from the graphene film 41, and the copper foil substrate 40 is removed from the graphene film 41 and the PMMA coating 42.

Figure 5:
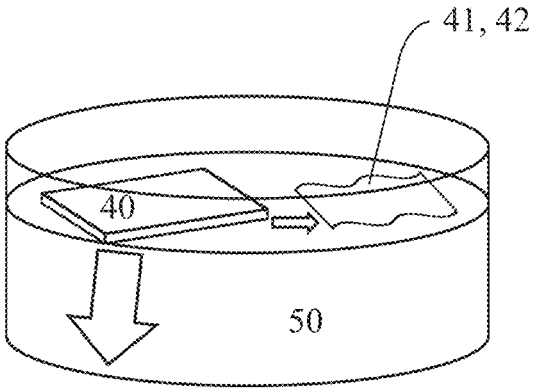
FIG. 5 to FIG. 7 are schematic diagrams illustrating multiple steps in the wet transfer scheme for transferring the produced graphene film to a substrate in accordance with the present invention.
Figure 6:
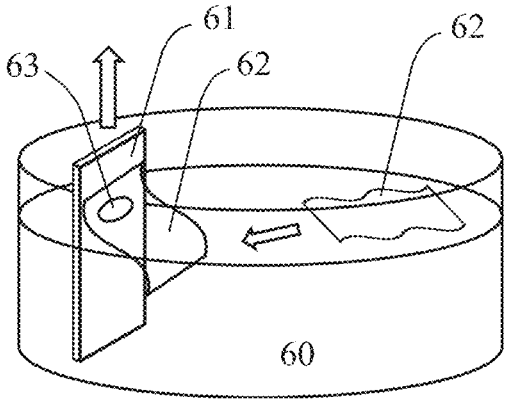
Figure 7:
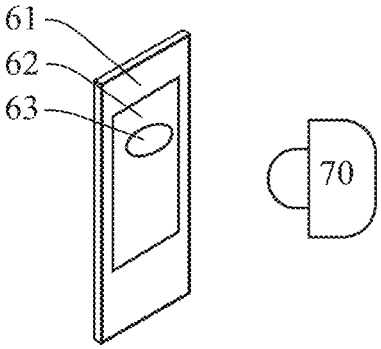

FIG. 5 to FIG. 7 are schematic diagrams illustrating multiple steps in the wet transfer scheme for transferring the produced graphene film to a substrate in accordance with the present invention. Then, by performing a wet transfer scheme, the graphene film 41 together with the PMMA coating 42 is transferred to another substrate, which has been previously cleaned with pure water. As shown in FIG. 5, chemical selective etching is first performed by immersing the graphene film 41 and the PMMA coating 42 into a solution 50 of ferric chloride ($FeCl_3$), which has characteristics of corroding copper material but not corroding graphene film, thereby removing the remaining copper foil substrate 40 left over on the graphene film 41 and separating a pure graphene film 41 with the PMMA coating 42 thereron.

Next, as shown in FIG. 6, the separated graphene film is immersed in deionized water for cleaning, and the graphene film is freely floated in deionized water. The substrate is immersed in the deionized water 60 as well, and the through hole 63 on the substrate 61 is roughly aligned with the graphene film 62. Then, the graphene film 62 is directly picked up or fished by the substrate 61, such that graphene film 62 is attached to around the through hole 63 of the substrate 61, as if suspending in the through hole 63 of the substrate 61. This step is also called a fishing procedure. In the present embodiment, the substrate 61 is exemplified by a silicon substrate. Next, as shown in FIG. 7, the substrate 61 on which the graphene film 62 is suspended on the through hole 63 is erected and dried by a heater 70 to form a final graphene composite target.

Figure 8:
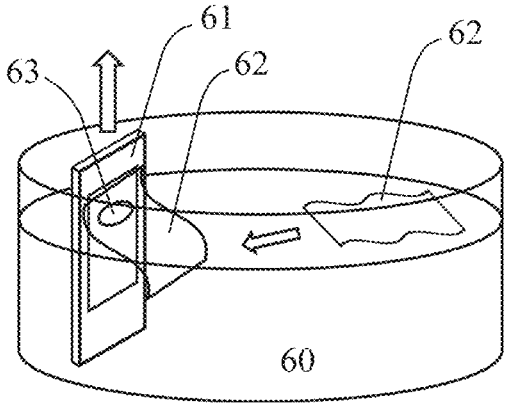
FIG. 8 is a schematic diagram illustrating a multiple-time wet transfer process that repeatedly transfers multiple generated graphene films onto a substrate to form a multilayer graphene film in accordance with the present invention.

FIG. 8 is a schematic diagram illustrating a multiple-time wet transfer process that repeatedly transfers multiple generated graphene films onto a substrate to form a multilayer graphene film in accordance with the present invention. By repeatedly performing the same steps of the above wet transfer scheme, multilayer graphene film can be attached to and suspended on the through hole of the substrate. In the present embodiment, the substrate is exemplified by a copper foil substrate. As shown in FIG. 8, a second layer of graphene film 62 is fished in deionized water 60 by using a copper foil substrate 61 to which a graphene film 62 has been attached to the through hole 63, so as to suspend double-layer graphene film layer on the substrate. Repeating the above wet transfer scheme can produce a multilayer graphene film, and finally form a multilayer graphene film suspended on the through hole of the substrate.

In addition to the wet transfer scheme, a dry transfer method with elastic and adhesive materials such as polyvinyl alcohol (PVA) or polydimethylsiloxane (PDMS) etc. as a substrate layer can also be used. A PVA or PDMS elastic substrate layer is first formed on the PMMA coating, and then the elastic substrate layer, together with the graphene film and the PMMA coating, is stamped on the through hole of the substrate to complete the transfer of graphene film. Next, if the PMMA coating needs to be removed, an annealing process at 500° C. can be selectively performed to remove the PMMA coating from the graphene film.

Figure 9:
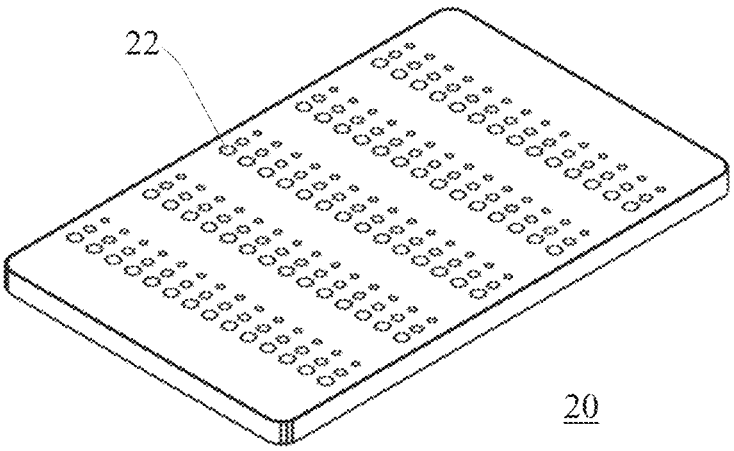
FIG. 9 is a schematic diagram illustrating a silicon chip substrate acting as a substrate of a composite target in accordance with the present invention.
Figure 10:
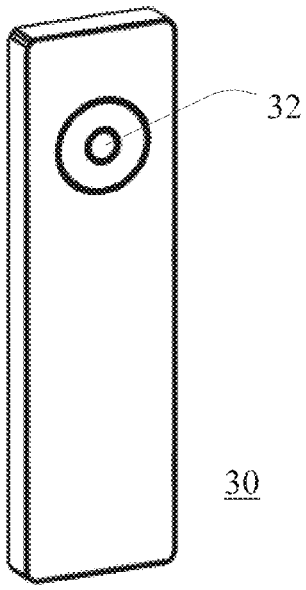
FIG. 10 is a schematic diagram illustrating a copper foil substrate acting as a substrate of a composite target in accordance with the present invention.

FIG. 9 is a schematic diagram illustrating a silicon chip substrate acting as a substrate of a composite target in accordance with the present invention. FIG. 10 is a schematic diagram illustrating a copper foil substrate acting as a substrate of a composite target in accordance with the present invention. As shown in FIG. 9, the substrate of the present embodiment, for example, is a silicon chip substrate 20 having a thickness of about 250 μm and distributed with a plurality of through holes 22 having a diameter of 100 μm to 500 μm thereon. As shown in FIG. 10, the substrate of the present embodiment, for example, is a copper foil substrate 30 having a considerable thickness and opened with a single through hole 32 thereon. However, the substrate material is not limited to silicon chip or copper foil. Any material which is relatively rigid, can provide a suitable support, and does not react with chemical substances used in the graphene transfer process can be used as a substrate, for example, a common stainless steel sheet, etc.

Figure 11:
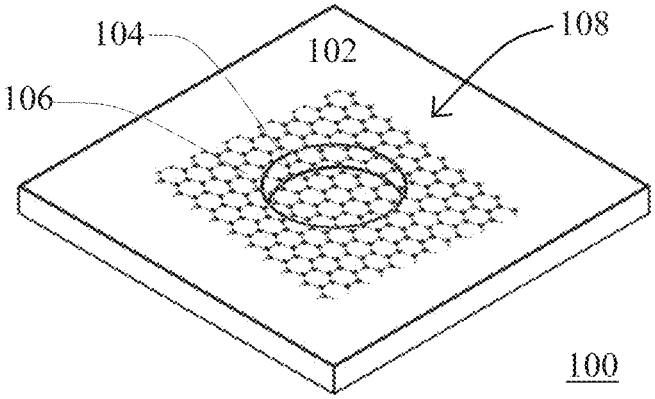
FIG. 11 is a schematic diagram illustrating a suspended graphene composite target provided in accordance with the present invention.

FIG. 11 is a schematic diagram illustrating a suspended graphene composite target provided in accordance with the present invention. The suspended graphene target finally produced by the present invention is shown in FIG. 11. The suspended graphene composite target 100 of the present invention includes a layer of graphene film 108 attached on the through hole 104 of the substrate 102 and on the substrate around the through hole 106. The whole graphene film 108 crosses the through hole 104 of the substrate 102, and a part of the graphene film 108 is suspended on the through hole 104 of the substrate 102, forming a suspended graphene composite target 100, or otherwise known as a suspending type or a free-standing type graphene composite target.

It is worth noting that by means of repeating the transfer method a plurality of times, a double-layer graphene film, a 4-layer graphene film, an 8-layer graphene film, or a multilayer graphene film can be produced. Further, with a graphene structure as a scaffold, a carbon-based material film, a hydrocarbon material film, and a metal film, such as a PMMA film, a plastic polymer film, an organic polymer film, a gold foil or a copper foil coating or the like can be formed on the graphene structure, which constitutes a composite target together with a graphene structure and a substrate. After ionization, particles such as protons and ions can be released. The thickness of the graphene film can be controlled simply and accurately by the CVD process, and the thickness of the total graphene film layer can also be controlled simply and accurately via the number of lamination of the multilayer graphene film.

Figure 12:
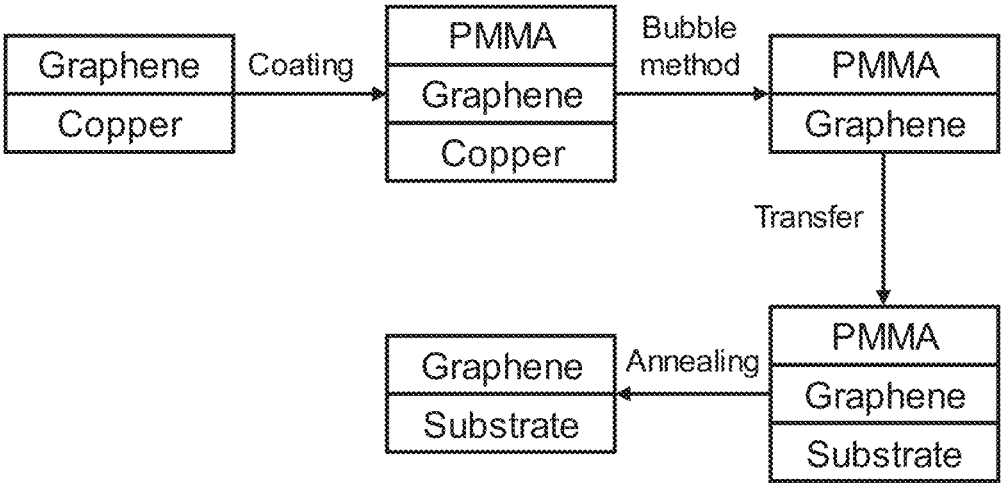
FIG. 12 is a flow chart illustrating multiple steps involved in processes manufacturing the composite target in accordance with the present invention.

FIG. 12 is a flow chart illustrating multiple steps involved in processes manufacturing the composite target in accordance with the present invention. As a brief summary, the manufacturing process of the composite target of the present invention is roughly divided into several steps, including first cleaning a copper foil substrate for providing the growth of a graphene film; performing RTCVD to grow a single layer of graphene film on the copper foil substrate, wherein the thickness of this graphene film can be as small as 1 nm close to the thickness of one atomic layer; using a spin coating method to form a layer of PMMA coating on the graphene film; using an electrolytic bubble method to remove the copper foil substrate attached to the graphene film; performing one or more transfer methods to combine the substrate with the graphene film or any other material film formed thereon to form a final composite target.

Figure 13:
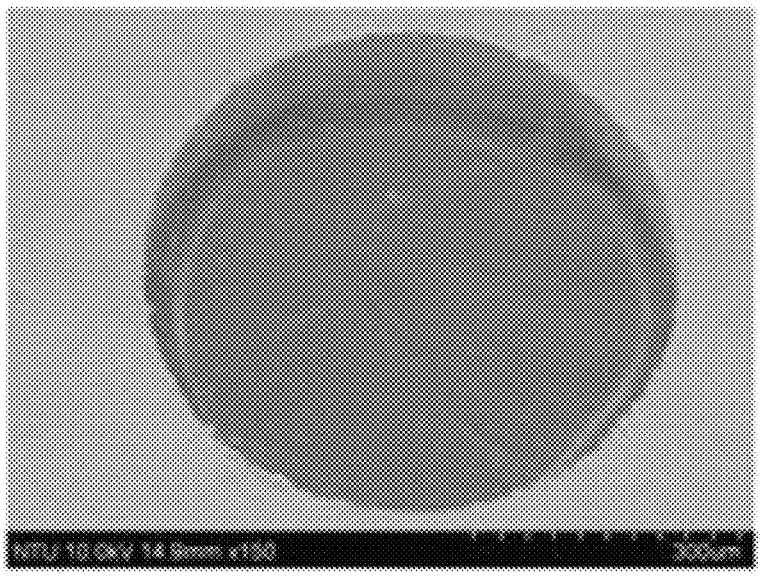
FIG. 13 is an image revealing an SEM image for a single layer suspended graphene structure suspended on the through hole of 500 μm diameter in accordance with the present invention.

In order to simultaneously detect the graphene film structure formed on the substrate, the synthesized graphene film was scanned by a scanning electron microscope (SEM) to obtain a series of SEM images. In addition to the structure of graphene film, the SEM image can also reveal defects such as impurities, cracks, folds, pores, and discontinuous structures and the like in the structure. FIG. 13 is an image revealing an SEM image for a single layer suspended graphene structure suspended on the through hole of 500 μm diameter in accordance with the present invention. The image revealed in FIG. 13 shows a substantially uniform and uncontaminated film structure.

Figure 14:
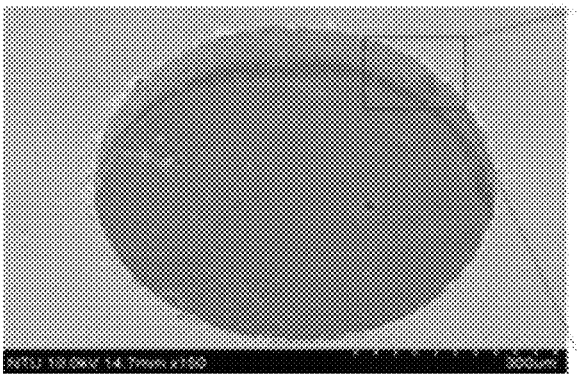
FIG. 14 is an image revealing an SEM image for a 4-layer suspended graphene structure (4L-SLG) suspended on the through hole of 500 μm diameter in accordance with the present invention.
Figure 15:
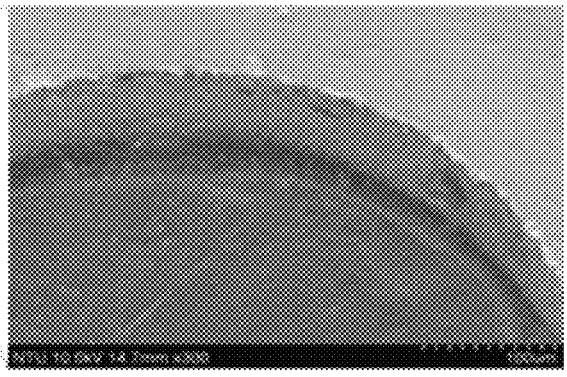
FIG. 15 is an image revealing an enlarged SEM image at the edge of the 4-layer suspended graphene structure in accordance with the present invention shown in FIG. 14.

FIG. 14 is an image revealing an SEM image for a 4-layer suspended graphene structure (4L-SLG) suspended on the through hole of 500 μm diameter in accordance with the present invention. FIG. 15 is an image revealing an enlarged SEM image at the edge of the 4-layer suspended graphene structure in accordance with the present invention shown in FIG. 14. The junction of the 4-layer suspended graphene with the silicon substrate and the continuous fracture band and the wrinkle structure of the silicon substrate at the junction can be clearly seen from FIG. 15. FIG. 15 also shows that the suspended graphene film is relatively flat compared to the silicon substrate.

Figure 16:
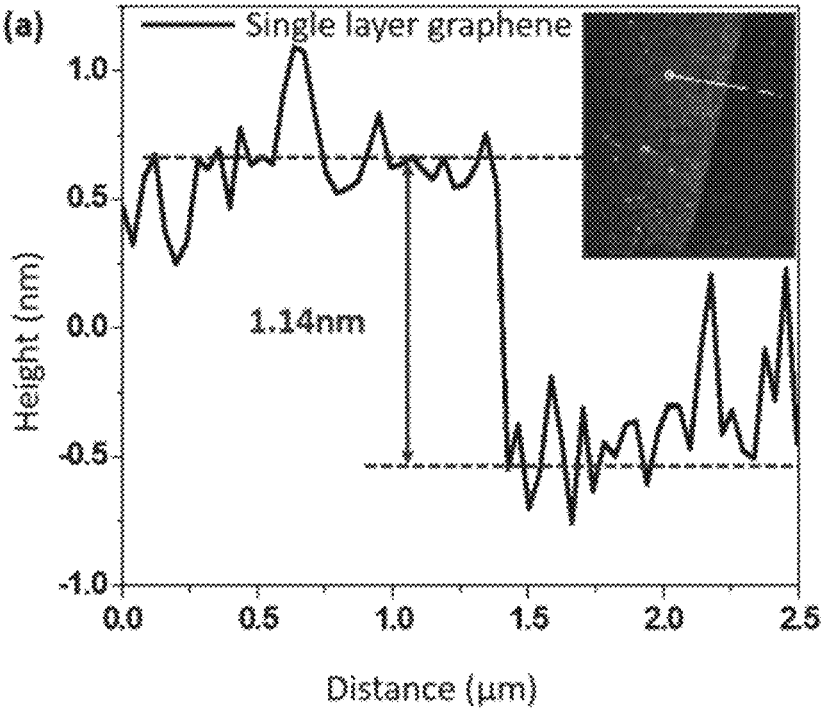
FIG. 16 is an image revealing an AFM image of a single layer suspended graphene structure (SLG) suspended on a through hole in accordance with the present invention.
Figure 17:
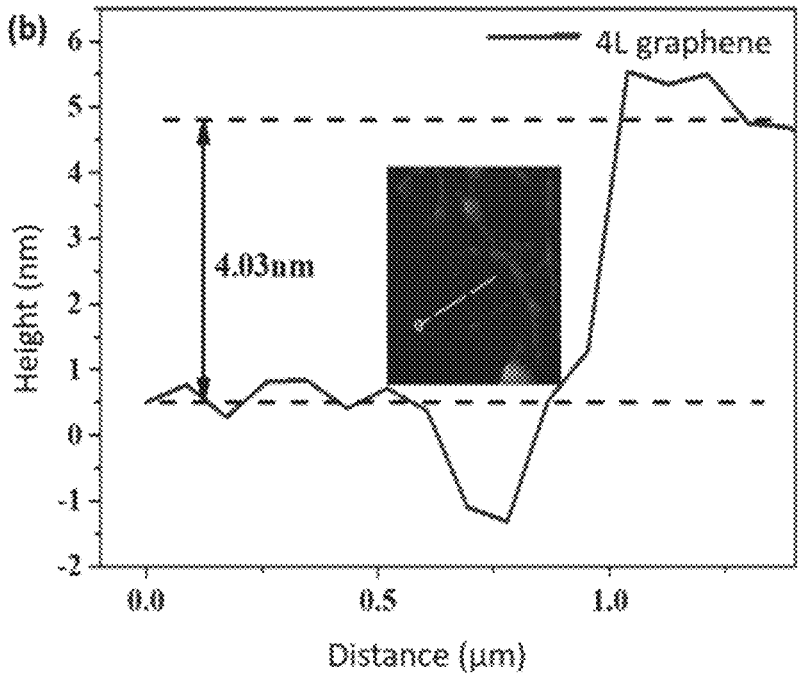
FIG. 17 is an image revealing an SEM image of a 4-layer suspended graphene structure (4L-SLG) suspended on a through hole in accordance with the present invention.

In order to detect the topographically structural features of the graphene film formed on the substrate, the synthesized graphene film is further scanned by a non-contact atomic force microscope (AFM) to obtain a series of scanned AFM images. Through AFM scanning, it is possible to accurately measure the graphene film structure, and the surface shape and dimension on a specific axis or a three-dimensional space on an atomic scale. FIG. 16 is an image revealing an AFM image of a single layer suspended graphene structure (SLG) suspended on a through hole in accordance with the present invention. FIG. 17 is an image revealing an SEM image of a 4-layer suspended graphene structure (4L-SLG) suspended on a through hole in accordance with the present invention. In FIG. 16 and FIG. 17, AFM is selected to scan the position where the graphene structure is suspended at the junction of the through hole, wherein the horizontal axis represents the distance of the sample in the horizontal direction in micrometers (μm), and the vertical axis represents the height of the sample in the vertical direction in nanometers (nm).

Figure 18:
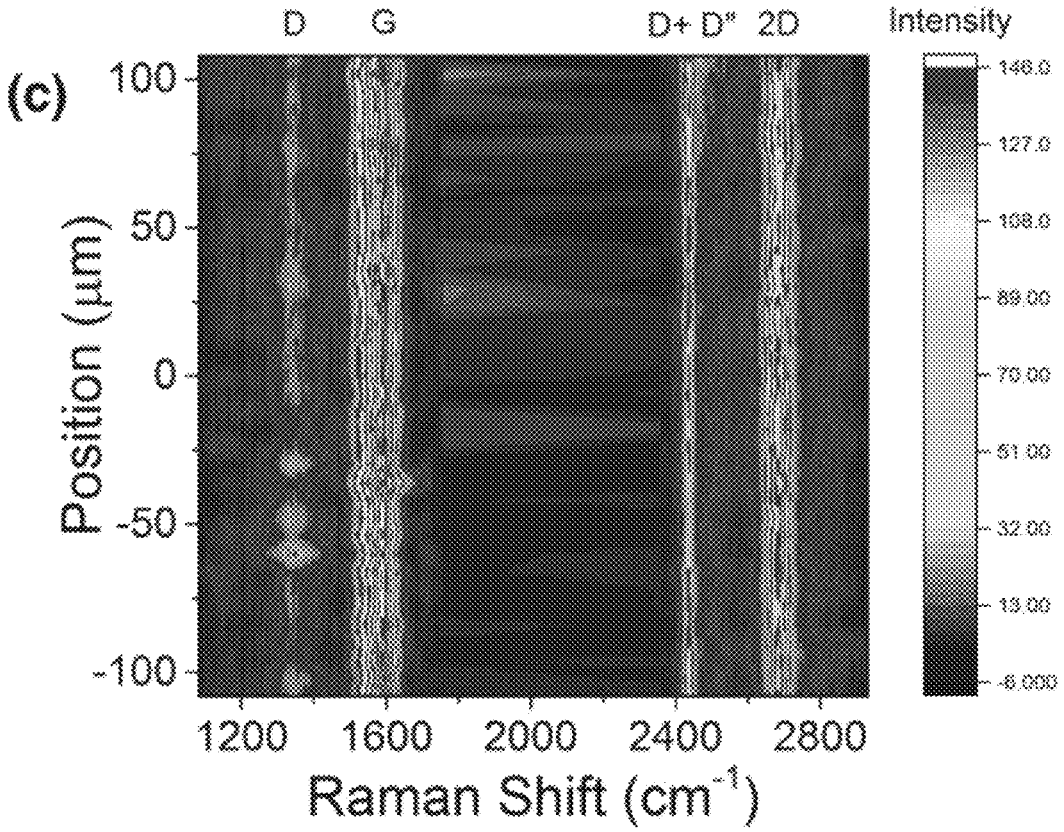
FIG. 18 is an image showing a Raman spectral image for a 4-layer suspended graphene structure (4L-SLG) in accordance with the present invention.

FIG. 18 is an image showing a Raman spectral image for a 4-layer suspended graphene structure (4L-SLG) in accordance with the present invention. In order to verify the presence and characteristics of the graphene, Raman spectroscopy was used to analyze the graphene films. The typical Raman fingerprint of graphene should contain two bands of G band at 1580 cm-1 and 2D band at 2680 cm-1. The Raman spectral image shown in FIG. 18 was obtained by Raman spectroscopic analysis along the axis of a 4-layer suspended graphene structure (4L-SLG) across a through hole of 250 μm diameter. From the image shown in FIG. 18, it can be seen that the Raman spectrum of the 4-layer suspended graphene structure of the present invention contains a typical G band and a 2D band, confirming that the material produced by the process of the present invention contains a graphene component. In addition to the G and 2D bands, the Raman spectrum of FIG. 18 also contains a small D band at 1350 cm-1 and a small D+D" band at 2450 cm-1, wherein the intensity of the D band is lower with respect to the G band, indicating that the graphene film prepared by the invention has a high crystallinity, so it has a relatively low defect density. The ratio of the 2D band to the G band is less than 1, indicating that the sample is a multilayer graphene structure. The 2D band and G band have similar band size and strength characteristics and high degree of similarity, indicating that the graphene film produced by the present invention has a wide range of uniformity.

Figure 19:
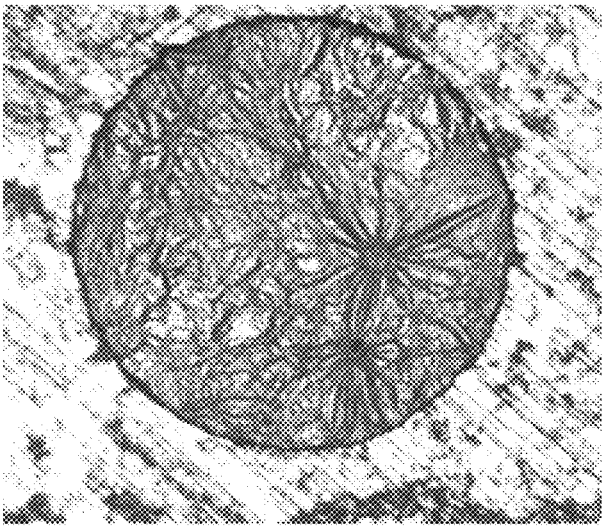
FIG. 19 is an image showing an optical microscope image for a single layer suspended graphene structure in accordance with the present invention.
Figure 20:
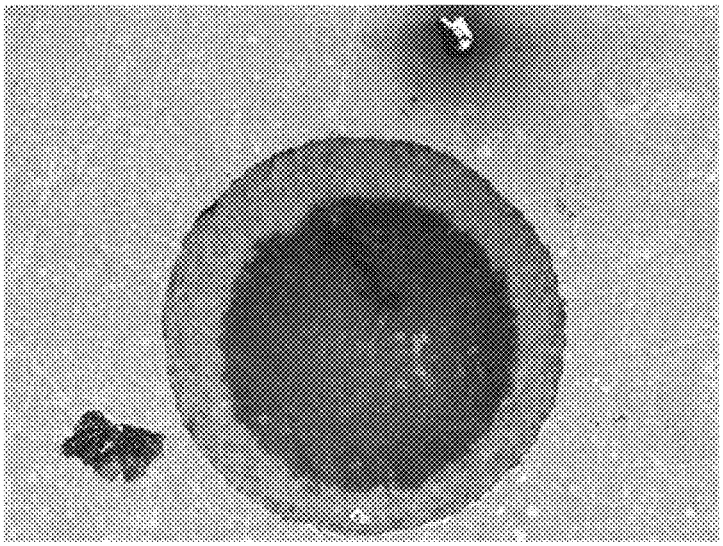
FIG. 20 is an image showing an SEM image for a single layer suspended graphene structure in accordance with the present invention.
Figure 21:
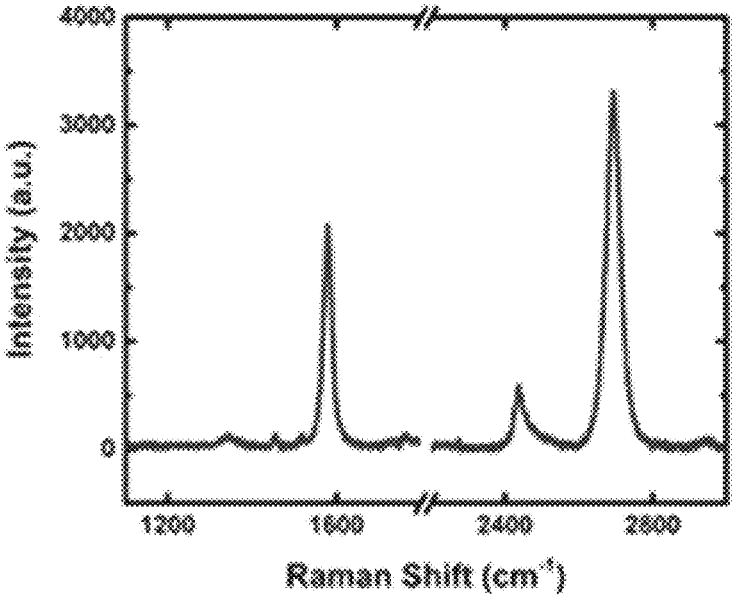
FIG. 21 is an image showing a Raman spectrum image for a single layer suspended graphene structure in accordance with the present invention on a specific section.
Figure 22:
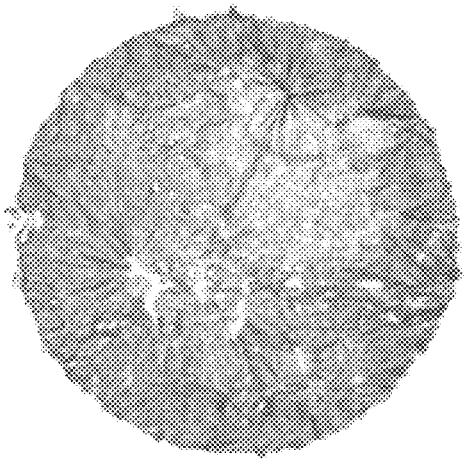
FIG. 22 is an image showing an optical microscope image for a composite structure formed by depositing a layer of 3 nm gold film on the single layer suspended graphene film in FIG. 19.
Figure 23:
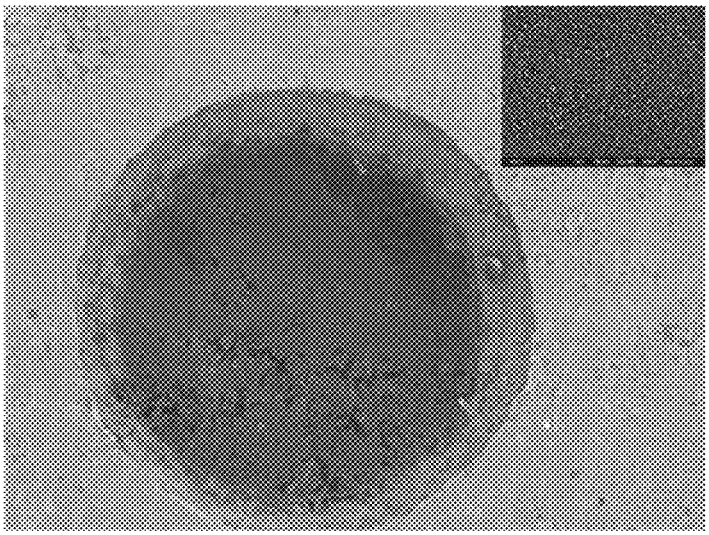
FIG. 23 is an image showing an SEM image for a composite structure formed by depositing a layer of 3 nm gold film on the single layer suspended graphene film in FIG. 19, wherein the inserted image at the upper right corner shows the morphology of gold nanoparticles.
Figure 24:
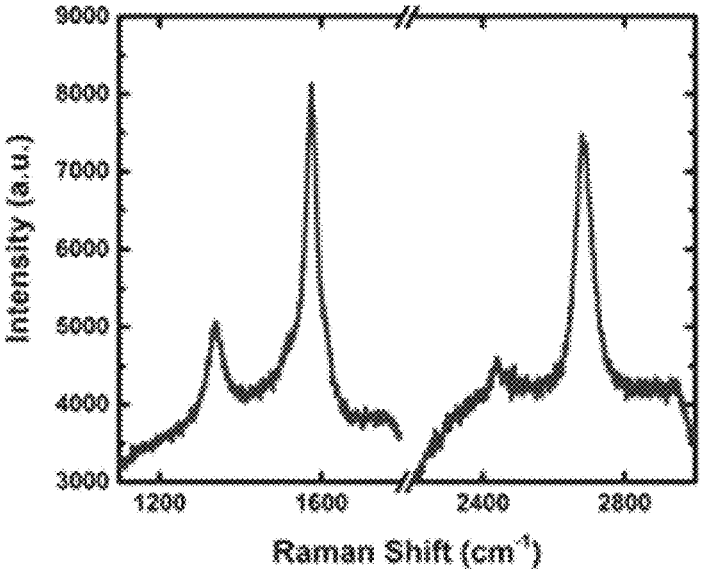
FIG. 24 is an image showing a Raman spectrum image for a specific section of a composite structure formed by depositing a layer of 3 nm gold film on the single layer suspended graphene film in FIG. 19.

FIG. 19 is an image showing an optical microscope image for a single layer suspended graphene structure in accordance with the present invention. FIG. 20 is an image showing an SEM image for a single layer suspended graphene structure in accordance with the present invention. FIG. 21 is an image showing a Raman spectrum image for a single layer suspended graphene structure in accordance with the present invention on a specific section. FIG. 22 is an image showing an optical microscope image for a composite structure formed by depositing a layer of 3 nm gold film on the single layer suspended graphene film in FIG. 19. FIG. 23 is an image showing an SEM image for a composite structure formed by depositing a layer of 3 nm gold film on the single layer suspended graphene film in FIG. 19, wherein the inserted image at the upper right corner shows the morphology of gold nanoparticles. FIG. 24 is an image showing a Raman spectrum image for a specific section of a composite structure formed by depositing a layer of 3 nm gold film on the single layer suspended graphene film in FIG. 19.

Figure 25:
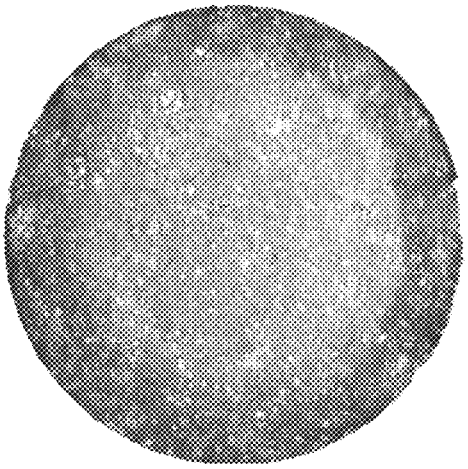
FIG. 25 is an image showing an optical microscope image for a 4-layer suspended graphene structure in accordance with the present invention.
Figure 26:
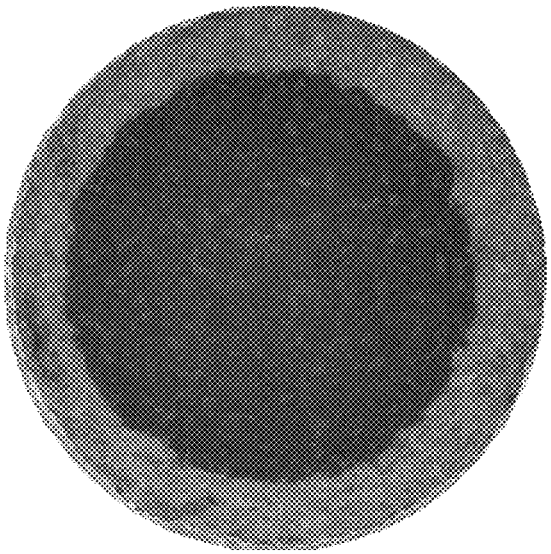
FIG. 26 is an image showing an SEM image for a 4-layer suspended graphene structure in accordance with the present invention.
Figure 27:
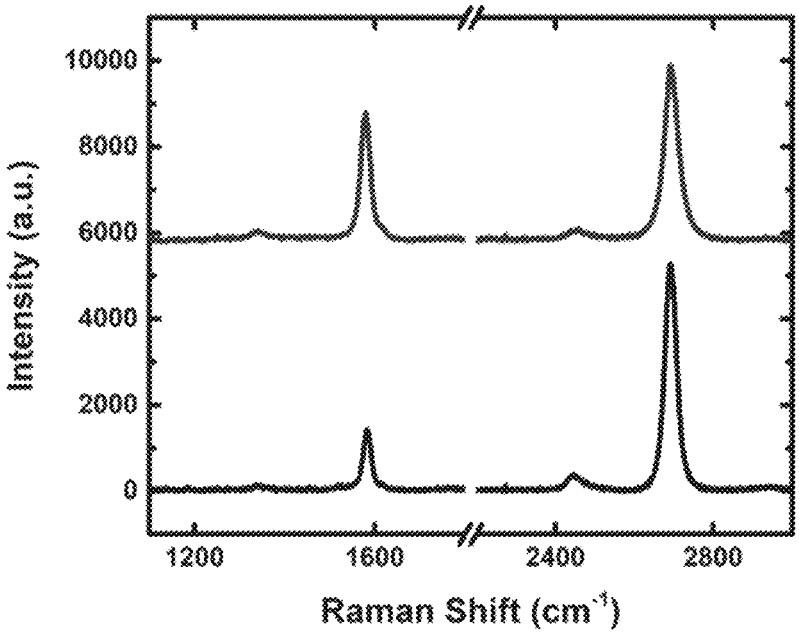
FIG. 27 is an image showing a Raman spectrum image for a 4-layer suspended graphene structure in accordance with the present invention on a specific section.
Figure 28:
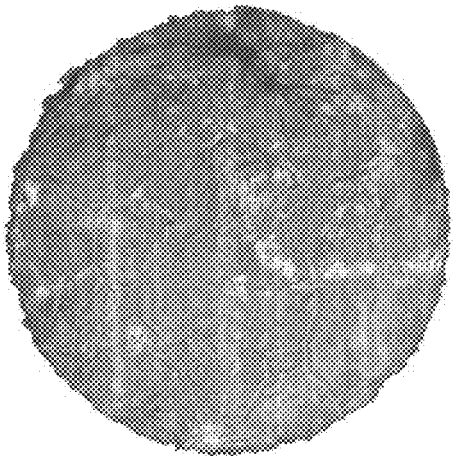
FIG. 28 is an image showing an optical microscope image for a composite structure formed by spin coating a layer of 12 nm PMMA film on the 4-layer suspended graphene film in FIG. 25.
Figure 29:
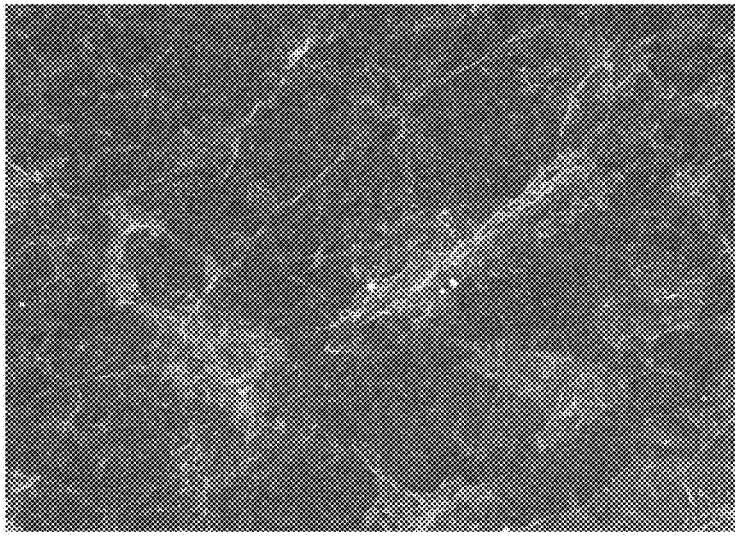
FIG. 29 is image showing an SEM image for a composite structure formed by spin coating a layer of 12 nm PMMA film on the 4-layer suspended graphene film in FIG. 25.
Figure 30:
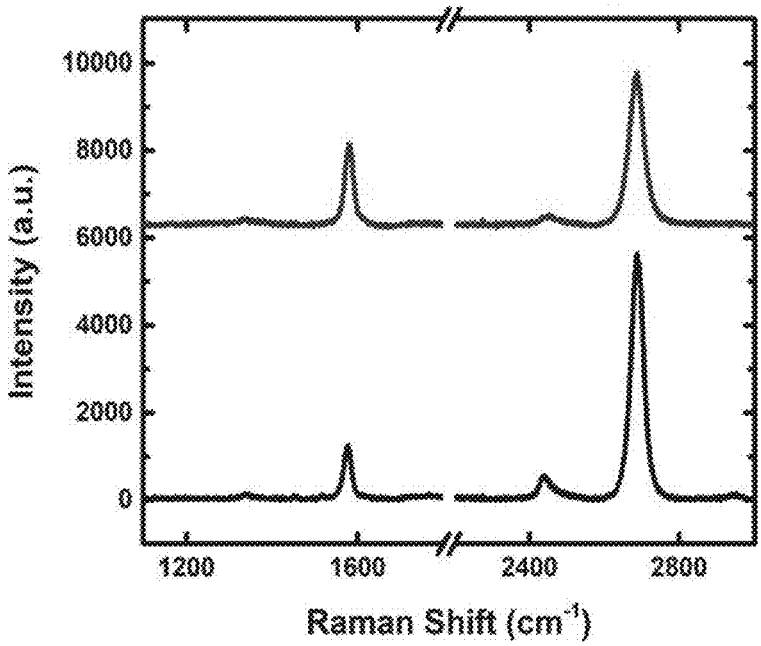
FIG. 30 is image showing a Raman spectrum image for a specific section of a composite structure formed by spin coating a layer of 12 nm PMMA film on the 4-layer suspended graphene film in FIG. 25.
Figure 31:
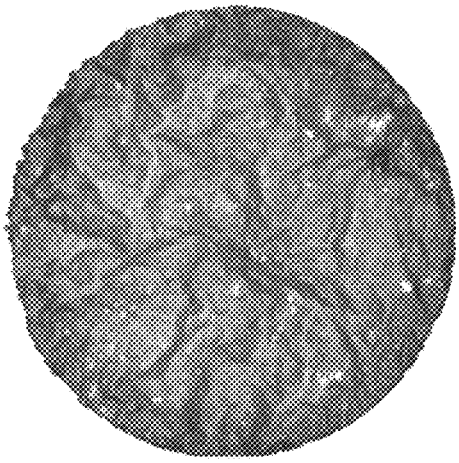
FIG. 31 is image showing an optical microscope image for a composite structure formed by depositing a layer of 3 nm gold film on the 4-layer suspended graphene film in FIG. 25.
Figure 32:
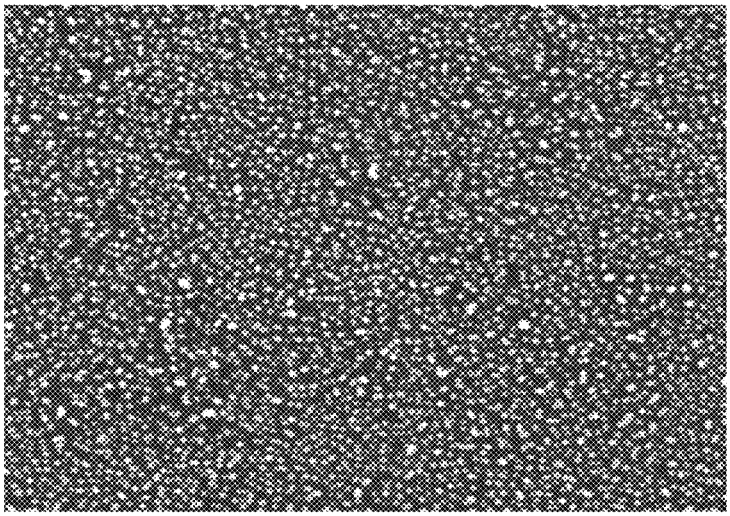
FIG. 32 is an image showing an SEM image for a composite structure formed by depositing a layer of 3 nm gold film on the 4-layer suspended graphene film in FIG. 25, wherein the inserted image at the upper right corner shows the morphology of gold nanoparticles.
Figure 33:
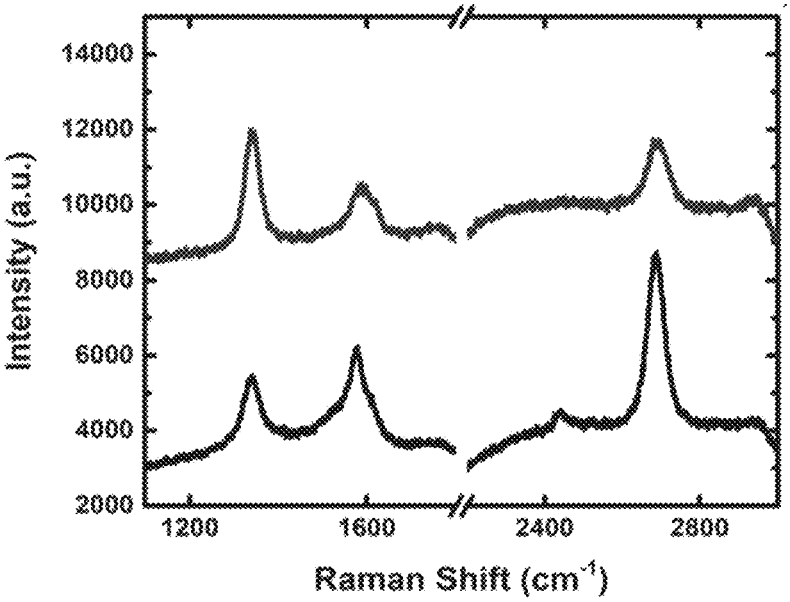
FIG. 33 is an image showing a Raman spectrum image for a specific section of a composite structure formed by depositing a layer of 3 nm gold film on the 4-layer suspended graphene film in FIG. 25.

FIG. 25 is an image showing an optical microscope image for a 4-layer suspended graphene structure in accordance with the present invention. FIG. 26 is an image showing an SEM image for a 4-layer suspended graphene structure in accordance with the present invention. FIG. 27 is an image showing a Raman spectrum image for a 4-layer suspended graphene structure in accordance with the present invention on a specific section. FIG. 28 is an image showing an optical microscope image for a composite structure formed by spin coating a layer of 12 nm PMMA film on the 4-layer suspended graphene film in FIG. 25. FIG. 29 is image showing an SEM image for a composite structure formed by spin coating a layer of 12 nm PMMA film on the 4-layer suspended graphene film in FIG. 25. FIG. 30 is image showing a Raman spectrum image for a specific section of a composite structure formed by spin coating a layer of 12 nm PMMA film on the 4-layer suspended graphene film in FIG. 25. FIG. 31 is image showing an optical microscope image for a composite structure formed by depositing a layer of 3 nm gold film on the 4-layer suspended graphene film in FIG. 25. FIG. 32 is an image showing an SEM image for a composite structure formed by depositing a layer of 3 nm gold film on the 4-layer suspended graphene film in FIG. 25, wherein the inserted image at the upper right corner shows the morphology of gold nanoparticles. FIG. 33 is an image showing a Raman spectrum image for a specific section of a composite structure formed by depositing a layer of 3 nm gold film on the 4-layer suspended graphene film in FIG. 25.

Figure 34:
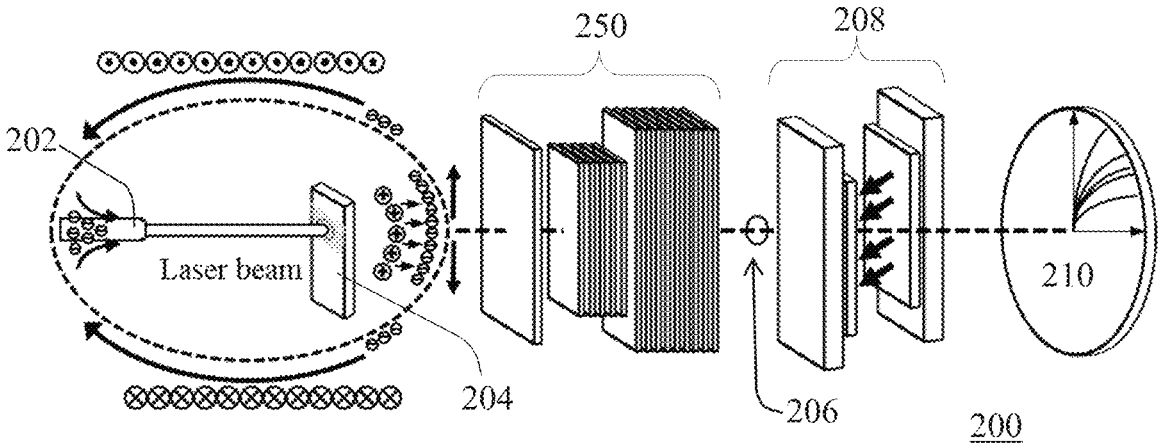
FIG. 34 is a schematic diagram illustrating a method used in the present invention for detecting a laser wake field.
Figure 35:
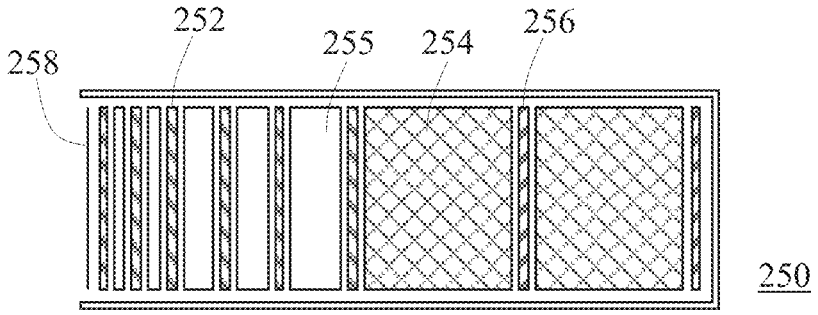
FIG. 35 is a schematic diagram illustrating a particle detection stack in accordance with the present invention.

FIG. 34 is a schematic diagram illustrating a method used in the present invention for detecting a laser wake field. FIG. 35 is a schematic diagram illustrating a particle detection stack in accordance with the present invention. The present invention uses a standard Thomson parabolic spectrometer to detect high-energy particles in the laser wake field, including detecting the existence and energy value of the high-energy particles. The configuration of particle detection 200 includes a high-energy laser emitter 202, a composite target 204 of the present invention, a composite particle detection stack 250, a Thomson pinhole 206, an electromagnetic field 208, and a micro channel plate (MCP) 210, etc. The high-energy laser emitter is preferably a Vulcan Petawatt high-energy laser in a double plasma-mirror (DPM) configuration. Preferably, a single-layer graphene film and a multilayer graphene film are used as the composite target 204. The thickness of the composite target can be determined by the transfer times of graphene film, and the thickness of each layer of graphene film is about 1 nm to respectively produce a single-layer graphene film composite target and an 8-layer graphene film composite target. High energy particle beams can be emitted from the composite target by the Vulcan Petawatt high-energy laser.

A composite particle detection stack 250 is provided between the composite target and the Thomson pinhole, as shown in FIG. 35. The composite particle detection stack 250 includes a stack arrangement of multilayer radio chromic films (RCFs) 252, a plurality of aluminum sheets 254, a plurality of iron sheets 255, a stack arrangement of multilayer CR-39 detection boards (TASTRAK) 256, and a protective aluminum foil 258 arranged at the front end of the composite particle detection stack 250. The RCFs can clearly show high-energy ions with color signals. When an ion passes through the RCFs, it will leave signals of different colors on the RCFs according to the energy carried by the ion. The higher the energy, the more layers of RCFs can be penetrated. By analyzing the RCFs of each layer, the distribution mode and energy carried by the ion can be clearly obtained. The CR-39 detection board can capture the ion sample of a proton as well as the carbon ion sample. When ions pass though the CR-39 detection board, different types and sizes of holes will be left on the CR-39 detection board according to different kinds of ions. By analyzing the types and sizes of the remaining holes on the CR-39 detection board, the types of ions detected can be inferred. The ion with higher energy can penetrate more layers of the CR-39 detection board. The aluminum sheet 254 inserted between the CR-39 detection boards 256 can absorb excess particle energy. Particles with different charge-to-mass ratio will eventually leave various parabolic trajectories with different curvatures on the MCP.

The thickness of the single layer graphene target provided in the invention is about 1 nm-2 nm, which is almost close to the thickness of one atomic layer. In regard to the technical field of laser driven ion acceleration (LIA), there is currently no thinner LIA target in the technical field. The single layer graphene target provided by the invention is the thinnest target in the state-of-the-art LIA technology. The thickness of the single layer graphene target provided by the invention is even smaller than the theoretical value of the minimum thickness of a target. The measurement results of the invention prove the durability of the single layer LSG target, and even the endurance of bombardment by Vulcan Petawatt high-energy laser with DPM configuration.

Figure 36:
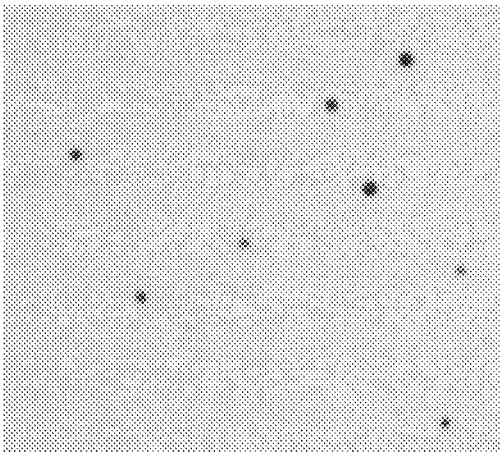
FIG. 36 to FIG. 38 are images showing holes punched through by particles emitted from the composite target in accordance with the present invention left on the fourth layer of CR-39 detection board.
Figure 37:
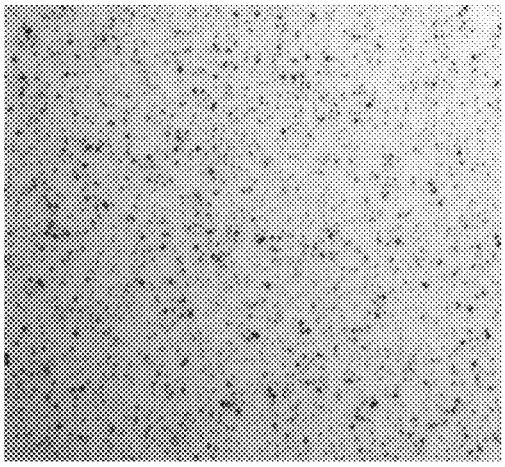
Figure 38:
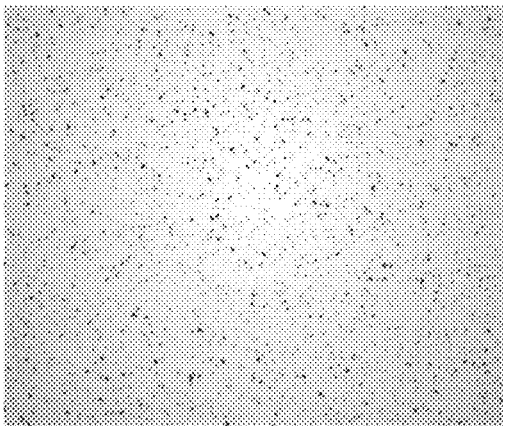

FIG. 36 to FIG. 38 are images showing holes punched through by particles emitted from the composite target in accordance with the present invention left on the fourth layer of CR-39 detection board. FIG. 36 shows the image of holes left on the fourth layer of CR-39 detection board when laser energy is 538 joules and 8-layer graphene film is used as target. FIG. 37 shows the image of the holes left on the fourth layer of CR-39 detection board when laser energy is 532 joules with 8-layer graphene film used as a front-end material towards the laser beam and 8 nm PMMA used as a back-end material to constitute a composite target. FIG. 38 shows the image of the holes left on the fourth layer of CR-39 detection board when laser energy is 711 joules with 8 nm PMMA used as a front-end material towards the laser beam and 8-layer graphene film used as a back-end material to constitute a composite target.

Figure 39:
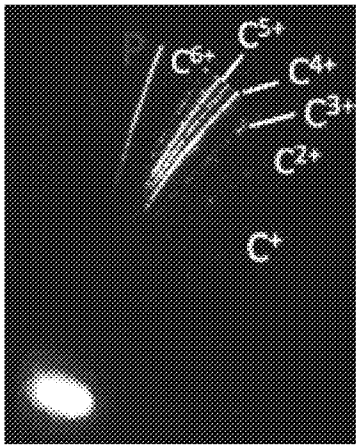
FIG. 39 and FIG. 42 are images showing multiple parabolic trajectories left on the MCP formed by various particles emitted by the composite target in accordance with the invention.
Figure 40:
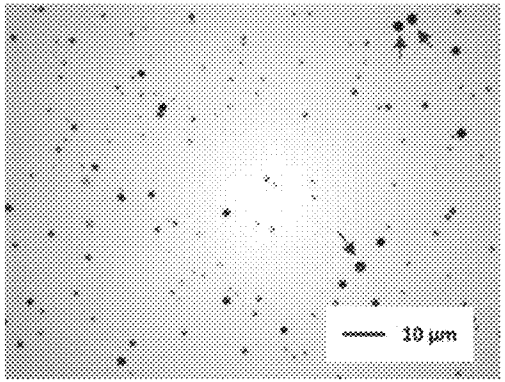
FIG. 40, FIG. 41, FIG. 43, and FIG. 44 are images showing holes punched through by particles emitted from the composite target in accordance with the present invention left on different layers of the CR-39 detection board.
Figure 41:
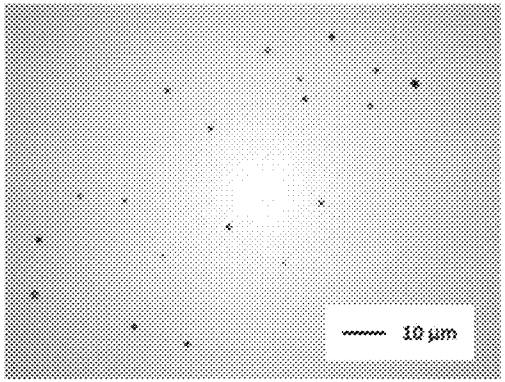
Figure 42:
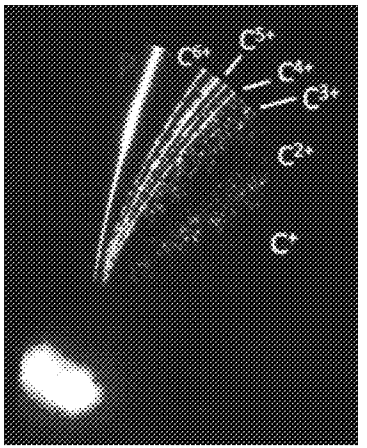

FIG. 39 and FIG. 42 are images showing multiple parabolic trajectories left on the MCP formed by various particles emitted by the composite target in accordance with the invention. FIG. 40, FIG. 41, FIG. 43, and FIG. 44 are images showing holes punched through by particles emitted from the composite target in accordance with the present invention left on different layers of the CR-39 detection board. FIG. 39 shows the parabolic trajectories of different curvatures formed on the MCP by the 8-layer graphene film composite target emitting protons and various carbon ions with different valence numbers. FIG. 40 shows the image of holes left on the first layer of the CR-39 detection board by the 8-layer graphene film composite target emitting protons and various carbon ions with different valence numbers. FIG. 41 shows the image of holes left on the second layer of the CR-39 detection board by the 8-layer graphene film composite target emitting protons and various carbon ions with different valence numbers.

Figure 43:
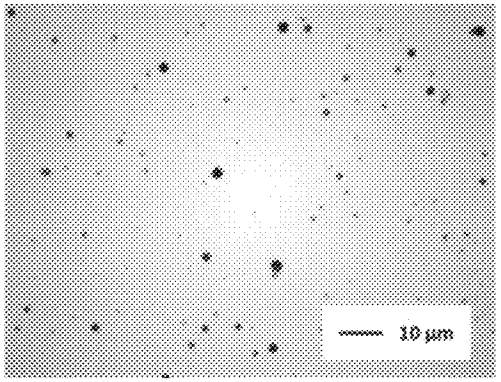
Figure 44:
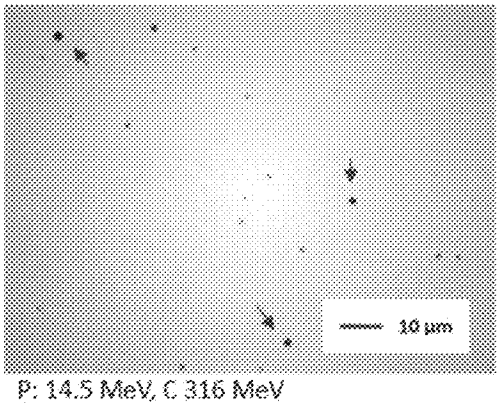

FIG. 42 shows the parabolic trajectories of different curvatures formed on the MCP by the 4-layer graphene film composite target emitting protons and various carbon ions with different valence numbers. FIG. 43 shows the image of holes left on the first layer of the CR-39 detection board by the composite target including a 4-layer graphene film and a 3 nm gold film and emitting protons and various carbon ions with different valence numbers. Nevertheless, the holes formed by the gold atoms are not found on the first layer of the CR-39 detection board revealed in FIG. 43. FIG. 44 shows the image of holes left on the second layer of the CR-39 detection board by the composite target including a 4-layer graphene film and a 3 nm gold film and emitting protons and various carbon ions with different valence numbers. Nevertheless, the holes formed by the gold atoms are not found on the second layer of the CR-39 detection board revealed in FIG. 44.

In summary, in addition to being used as a scaffold for carrying any material film as a composite target, the graphene film of the present invention itself can also be used as an ion radiation target alone. Any material film can be, for example, a PMMA, a hydrocarbon material film, a metal film, a precious metal film, an Au thin film, a polymer film, an organic plastic film, a carbon nanotube array film, or a ZnO nano column array film, etc. These nano films of any material can be formed on LSG by means of CVD, ALD, PVD, etc.

According to the detection results of the present invention, the multilayer graphene film is very suitable to be used as a scaffold for carrying any material film as an ion radiation composite target. If a single-layer graphene film combined with a gold film is used as an ion radiation composite target, heavy ions and high Z ions can be emitted by high-energy laser bombardment.

In the present invention, the composite target formed by LSG combined with PMMA film can generate high-energy and high-density carbon ions after ionization, and, compared with the multilayer graphene film target, can generate higher ion flux. Furthermore, the ion-generating composite target provided by the invention can effectively improve the tolerance of the target to high-intensity laser pre-pulse, greatly increase the generation efficiency of high-energy carbon ions, and can also provide a mechanism for accelerating particles of high atomic mass and high electric charge value.

There are further embodiments provided as follows.

Embodiment 1

An ion generation composite target for an ion irradiation technology includes a substrate having a through hole formed thereon; and a graphene thin film configured on the substrate, across the through hole, having a thickness in a range between 1 nm to 3 nm, and ionized to release a proton or a carbon ion.

Embodiment 2

The ion generation composite target as described in Embodiment 1 further includes one of the components as follows: a plurality of layers of the graphene thin film configured on the substrate, across the through hole, and each of the plurality of layers of the graphene thin film having a thickness in a range between 1 nm to 3 nm; a carbon-based thin film configured on the graphene thin film, having a thickness less than 20 nm, and ionized to release a proton or a carbon ion; a hydrocarbon-based thin film configured on the graphene thin film, having a thickness less than 20 nm, and ionized to release a proton or a carbon ion; and a metallic material thin film configured on the graphene thin film, having a thickness in a range between 1 nm to 4 nm, and ionized to release a proton or a metallic material ion.

Embodiment 3

The ion generation composite target as described in Embodiment 1, the ion generation composite target is manufactured by implementing one selected from a rapid-thermal chemical vapor deposition scheme, a vapor deposition scheme, a rapid thermal anneal scheme, an atomic layer deposition scheme, a spin coating scheme, an electrolysis bubble scheme, a wet transfer scheme, a dry transfer scheme, and a combination thereof.

Embodiment 4

The ion generation composite target as described in Embodiment 1, the carbon-based thin film is one selected from an acrylic thin film, a PMMA thin film, a plastic thin film, and an organic polymer thin film, the hydrocarbon-based thin film is one selected from an acrylic thin film, a PMMA thin film, a plastic thin film, and an organic polymer thin film, the metallic material thin film is one selected from a precious metal thin film, a gold thin film, and a copper foil.

Embodiment 5

The ion generation composite target as described in Embodiment 1, the ion irradiation technology is one selected from a laser-driven ion acceleration technology, an ion irradiation medical technology, a cancer irradiation therapy technology, a high resolution irradiation imaging technology, a fusion ignition technology, an energetic particle irradiation technology, and a laboratory astrophysics technology.

Embodiment 6

An ion generation composite target for an ion irradiation technology includes: a substrate having a through hole formed thereon; and a plurality of layers of a graphene thin film configured on the substrate, across the through hole, each of the plurality of layers of the graphene thin film having a thickness in a range between 1 nm to 3 nm, and ionized to release a proton or a carbon ion.

Embodiment 7

A laser-driven ion acceleration apparatus includes: a laser emitting a laser beam; and a composite target including: a substrate having a through hole providing for the laser beam to pass through; and a graphene thin film configured on the substrate, across the through hole, having a thickness in a range between 1 nm to 3 nm, and ionized to release a proton or a carbon ion.

Embodiment 8

The laser-driven ion acceleration apparatus as described in Embodiment 7, the composite target further includes one of the components as follows: a plurality of layers of the graphene thin film configured on the substrate, across the through hole, and each of the plurality of layers of the graphene thin film having a thickness in a range between 1 nm to 3 nm; a carbon-based thin film configured on the graphene thin film, having a thickness less than 20 nm, and ionized to release a proton or a carbon ion; a hydrocarbon-based thin film configured on the graphene thin film, having a thickness less than 20 nm, and ionized to release a proton or a carbon ion; and a metallic material thin film configured on the graphene thin film, having a thickness in a range between 1 nm to 4 nm, and ionized to release a proton or a metallic material ion.

Embodiment 9

The laser-driven ion acceleration apparatus as described in Embodiment 8, the composite target is configured to use the graphene thin film as a front side to contact the laser beam first, the composite target is configured to use the plurality of layers of the graphene thin film as a front side to contact the laser beam first, the composite target is configured to use the carbon-based thin film as a front side to contact the laser beam first, the composite target is configured to use the hydrocarbon-based thin film as a front side to contact the laser beam first, and the composite target is configured to use the metallic material thin film as a front side to contact the laser beam first.

Embodiment 10

The laser-driven ion acceleration apparatus as described in Embodiment 9, the front side has a normal line which is angled with the laser beam in range between 0° degree to 60° degree.

While the disclosure has been described in terms of what are presently considered to be the most practical and preferred embodiments, it is to be understood that the disclosure need not be limited to the disclosed embodiments. On the contrary, it is intended to cover various modifications and similar arrangements included within the spirit and scope of the appended claims, which are to be accorded with the broadest interpretation so as to encompass all such modifications and similar structures. Therefore, the above description and illustration should not be taken as limiting the scope of the present disclosure which is defined by the appended claims.

What is claimed is:

1. An ion generation composite target ionized to release a proton or a carbon ion for an ion irradiation technology, comprising:

a substrate having a through hole formed thereon;

a plurality of layers of a graphene thin film configured on the substrate as a scaffold for supporting at least one thin film, across the through hole, and each of the plurality of layers of the graphene thin film having a thickness in a range between 1 nm to 3 nm; and the at least one thin film being either a carbon-based thin film having a thickness less than 20 nm, a hydrocarbon-based thin film having a thickness less than 20 nm, or a metallic material thin film having a thickness in a range between 1 nm to 4 nm, configured with the plurality of layers of the graphene thin film and across the through hole, wherein the carbon-based thin film is one selected from an acrylic thin film, a PMMA thin film, a plastic thin film, and an organic polymer thin film, the hydrocarbon-based thin film is one selected from an acrylic thin film, a PMMA thin film, a plastic thin film, and an organic polymer thin film, and the metallic material thin film is one selected from a precious metal thin film, a gold thin film, and a copper foil.

2. The ion generation composite target as claimed in claim 1, wherein the ion generation composite target is manufactured by implementing one selected from a rapid-thermal chemical vapor deposition scheme, a vapor deposition scheme, a rapid thermal anneal scheme, an atomic layer deposition scheme, a spin coating scheme, an electrolysis bubble scheme, a wet transfer scheme, a dry transfer scheme, and a combination thereof.

3. The ion generation composite target as claimed in claim 1, wherein the ion irradiation technology is one selected from a laser-driven ion acceleration technology, an ion irradiation medical technology, a cancer irradiation therapy technology, a high resolution irradiation imaging technology, a fusion ignition technology, an energetic particle irradiation technology, and a laboratory astrophysics technology.

4. A laser-driven ion acceleration apparatus, comprising:

a laser emitting a laser beam; and a composite target ionized to release a proton or a carbon ion and comprising:

a substrate having a through hole providing for the laser beam to pass through;

a plurality of layers of a graphene thin film configured on the substrate as a scaffold for supporting at least one thin film, across the through hole, and each of the plurality of layers of the graphene thin film having a thickness in a range between 1 nm to 3 nm; and the at least one thin film being either a carbon-based thin film having a thickness less than 20 nm, a hydrocarbon-based thin film having a thickness less than 20 nm, or a metallic material thin film having a thickness in a range between 1 nm to 4 nm, configured with the plurality of layers of the graphene thin film and across the through hole, wherein the carbon-based thin film is one selected from an acrylic thin film, a PMMA thin film, a plastic thin film, and an organic polymer thin film, the hydrocarbon-based thin film is one selected from an acrylic thin film, a PMMA thin film, a plastic thin film, and an organic polymer thin film, and the metallic material thin film is one selected from a precious metal thin film, a gold thin film, and a copper foil.

5. The laser-driven ion acceleration apparatus as claimed in claim 4, wherein the composite target is configured to use one of the plurality of layers of the graphene thin film as a front side facing toward the laser beam, the composite target is configured to use the carbon-based thin film as a front side facing toward the laser beam, the composite target is configured to use the hydrocarbon-based thin film as a front side facing toward the laser beam, or the composite target is configured to use the metallic material thin film as a front side facing toward the laser beam.

6. The laser-driven ion acceleration apparatus as claimed in claim 5, wherein the front side has a normal line which is angled with the laser beam in range between 0° degree to 60° degree.

* * * * *